US005980771A

United States Patent [19]

Cowan

[11] Patent Number: 5,980,771

[45] Date of Patent: Nov. 9, 1999

[54] METHOD AND APPARATUS FOR REGENERATING AN ETCH SOLUTION

[75] Inventor: Robert Cowan, Mission Viejo, Calif.

[73] Assignee: Aerochem, Inc., Orange, Calif.

[ * ] Notice: This patent issued on a continued prosecution application filed under 37 CFR 1.53(d), and is subject to the twenty year patent term provisions of 35 U.S.C. 154(a)(2).

[21] Appl. No.: 08/790,202

[22] Filed: Feb. 5, 1997

[51] Int. Cl.[6] ..... B44C 1/22

[52] U.S. Cl. ..... 216/93; 216/102

[58] Field of Search ..... 216/102, 93

[56] References Cited

U.S. PATENT DOCUMENTS

| | | | |
|---|---|---|---|
| 2,975,041 | 3/1961 | Holman . | |
| 4,372,805 | 2/1983 | Takahashi et al. | 156/642 |
| 4,960,511 | 10/1990 | Dofle et al. | 210/96.1 |
| 5,049,233 | 9/1991 | Davis | 156/642 |
| 5,091,046 | 2/1992 | Hunter et al. | 156/642 |
| 5,227,010 | 7/1993 | Lubert et al. | 156/642 |
| 5,275,691 | 1/1994 | Fukuta et al. | 156/642 |

FOREIGN PATENT DOCUMENTS 51-136573 11/1976 Japan .

*Primary Examiner*—Thi Dang
*Assistant Examiner*—George Goudreau
*Attorney, Agent, or Firm*—James E. Brunton

[57] ABSTRACT

A method and apparatus for economically regenerating chemical etch solutions for aluminum and the alloys thereof without the use of large, complex and expensive processing apparatus. The method of the invention can be accomplished substantially at ambient temperature thereby avoiding the necessity for substantial investment in complex temperature control instrumentation. In accordance with the method of the invention, the spent etchant which is to be regenerated is first mixed with water in a separate storage tank and is then cold filtered prior to being transferred to the reactor or regeneration vessel. This step substantially reduces contamination buildup within the reactor vessel and thereby avoids costly periodic shut down of operations for clean-up. Due to the unique nature of the regeneration process of the invention, the alumina produced as a by product of the process is of extremely high quality and is snow white in color.

11 Claims, 1 Drawing Sheet

METHOD AND APPARATUS FOR REGENERATING AN ETCH SOLUTION

BACKGROUND OF THE INVENTION

1. Field of the Invention

The present invention relates generally to a method and apparatus for regenerating caustic etch solutions of the type used in chemically milling aluminum and aluminum alloy parts. More particularly, the invention concerns a simple and straight forward method for regenerating cold filtered sodium hydroxide etching solutions using large reaction vessels which operate at ambient temperature.

2. Discussion of the Invention

Chemical milling is widely used in the prior art for precisely contouring the surfaces of various types of parts which have a particular configuration that makes surface contouring difficult or impossible using conventional milling machines. The technique is particularly useful in milling large sheet metal workpieces to uniform wall thicknesses.

Typically the chemical milling etchant used in large scale commercial aluminum chemical milling operations comprises a sodium hydroxide solution containing a small amount of dissolved aluminum. During the chemical milling process, the sodium hydroxide is consumed and the soluble compound, sodium aluminate, is formed. As the milling process progresses, the etching rate declines in proportion to the gradual decrease in the concentration of free sodium hydroxide and the simultaneous increase in the concentration of the dissolved aluminum. When the dissolved aluminum concentration reaches a certain level, it adversely affects the quality and effectiveness of the etchant and the spent solution must either be pumped out and replaced with fresh etchant, or the solution must be regenerated.

A novel and useful method and apparatus for accomplishing production scale chemical milling is described in U.S. Pat. No. 4,523,973 issued to Nelson. Similarly, a generally typical prior art method for etching aluminum and aluminum alloy bodies is described in U.S. Pat. No. 2,975,041 issued to Holman.

In accordance with prior art practices, when regeneration of the etchant solution became necessary, the regeneration process was accomplished by seeding the spent etchant with alumina trihydrate crystals under closely controlled temperature regimens. During the regeneration process, the dissolved sodium aluminate within the solution reacts with the alumina trihydrate crystals to form more alumina trihydrate and to regenerate sodium hydroxide as follows:

Sodium Aluminate→Alumina Trihydrate+Sodium Hydroxide

Typically, the conventional prior art caustic regenerators used to regenerate the spent etchant typically operated at very closely controlled elevated temperatures of on the order of 130 degrees Fahrenheit. Because the conventional belief of those skilled in the art was that precise temperature control of the crystallization process was imperative, the regenerators often embodied complex and costly temperature control systems. Additionally, the more successful prior art regeneration systems were operated on a continuous flow basis thereby further adding to the cost and complexity of the regenerator systems.

By way of example, one prior art method and apparatus for regenerating an etch solution at an elevated temperature is disclosed in U.S. Pat. No. 4,372,805 issued to Takahashi, et al. The method and apparatus described in this patent includes the steps of withdrawing a portion of the etchant from a reservoir, adding a polymeric flocculent in a thickener to form a solid sulfide and then removing the solid sulfide from the thickener by means of a nozzle. The supernatant liquid in the thickener is then introduced into a crystallizer and water is added. Next, the crystallized aluminum oxide is separated and removed from the crystallizer by means of a centrifugal separator. The alkaline liquid which is discharged from the crystallizer as an overflow supernatant is then introduced into a recovery tank and concentrated by means of an evaporator. Finally the concentrated liquid is removed from the evaporator and returned to the etchant tank with or without the addition of sodium hydroxide and/or sodium sulfide.

U.S. Pat. No. 5,091,046 issued to Hunter et al discloses a process for etching aluminum in caustic solution capable of providing a consistently uniform matte finish like that of the never dump process, but with little waste like the regeneration process. Etching is performed in a solution containing free sodium hydroxide and dissolved aluminum in a ratio between about 0.6 and 2.1 g/l and also containing an etch equalizing agent at a temperature above about 70° C. In column 4, starting at line 63, Hunter describes the "conventional regeneration process" as being "typically operated at a temperature between about 55° C. and 60° C., with an aluminum concentration between about 25 and 30 g/l, and a free sodium hydroxide between about 50 and 70 g/l for aluminum. Hunter continues pointing out that in his invention "the etch temperature is higher than about 70° C., preferably about 80° C."

As will be better appreciated from the discussion which follows, the method and apparatus of the present invention greatly simplifies the process and apparatus for regeneration of the etchant solutions and, for the first time, provides a simple, regeneration system which operates at ambient temperature and requires no complex equipment, instrumentation or controls. Since the method uses large vessels which operate at ambient temperature, no sophisticated and costly temperature control instrumentation is required.

SUMMARY OF THE INVENTION

It is an object of the present invention to provide a method and apparatus for inexpensively regenerating an etch solution for aluminum and the alloys thereof using reaction vessels which operate at ambient temperature.

More particularly, it is an object of the present invention to provide a method of the character described for regenerating etch solutions for aluminum and the alloys thereof which can be accomplished using processing apparatus which does not require complex and expensive temperature control systems of any kind.

Another object of the invention is to provide a method for regenerating an etchant solution which includes the novel step of cooling the etchant solution to room temperature, transferring the solution to a storage tank, adding dilution water, allowing the mixture thus formed to mix for about 24 hours and then cold filtering the mixture prior to introducing it into the reactor vessel.

Another object of the present invention is to provide a novel etchant regeneration apparatus that is easy to install, requires little maintenance and clean-up, and one which can be operated and maintained on a continuous basis by relatively unskilled workers.

Another object of the invention is to provide an apparatus of the character described in which the regeneration tank is separated from the storage tank wherein the spent etchant solution is diluted and receives the diluted, spent etchant only after it has been cold filtered.

Another object of the invention is to provide a method and apparatus for etchant regeneration which requires little monitoring of operating parameters and can be operated in either a continuous or semi-continuous mode.

DESCRIPTION OF THE INVENTION

Figure 1:
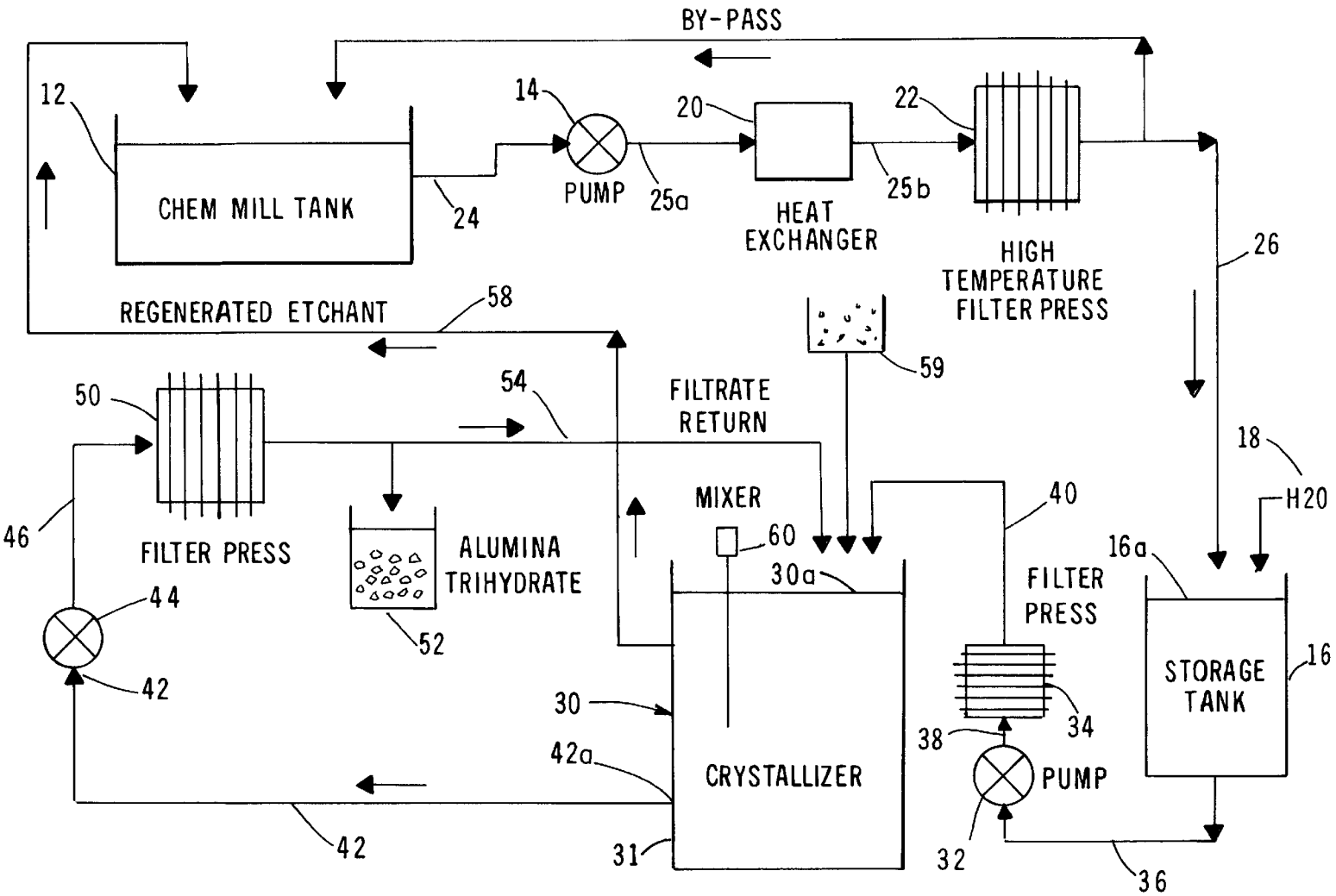
FIG. 1 is a generally schematic view illustrating one form of the apparatus of the invention and the method of its use in carrying out the process of the invention.

Referring to FIG. 1, the apparatus of one form of the present invention for use in regenerating an etchant solution is there schematically shown. The apparatus of the invention is specially suited for regenerating etchant solution of the character typically used for chemically milling aluminum and aluminum alloy parts. During the chemical milling operation, the parts to be milled are typically submersed into an etchant or chemical milling tank 12 which is adapted to contain the chemical etchant. Typically, the chemical etchant solution comprises a sodium hydroxide solution containing a small amount of dissolved aluminum.

Operably connected with tank 12 via a first transfer means, which includes a first pump 14, is a storage tank 16. As indicated in FIG. 1, storage tank 16, which can be of any suitable configuration, is interconnected with a source of water 18. Disposed intermediate first pump 14 and storage tank 16 is a heat exchanger 20 and a filter means both of which also comprise a part of the first transfer means. The filter means, the purpose of which will presently be described, is here provided as a conventional, high-temperature filter press 22. Filter press 22 as well as heat exchanger 20 are readily commercially available and their construction and operation are well understood by those skilled in the art. A conduit 24 interconnects pump 14 with tank 12, while a conduit 26 interconnects filter press 22 with the upper portion 16*a* of storage tank 16. A conduit 25*a* interconnects pump 14 with heat exchanger 20 and a conduit 25*b* interconnects heat exchanger 20 with filter press 22. The first transfer means of the invention as thus described functions to controllably transfer spent etchant from the chemical milling tank 12 to the storage tank 16 where it can be mixed with water supplied by water source 18.

It is important to note that, in accordance with the method of the invention, the first transfer means of the invention functions to first cool the spent etchant using the heat exchanger 20, then to filter the cooled etchant using the filter press 22 and then to transfer the cooled and filtered etchant to the storage tank 16 which is separate and apart from the crystallizer or regenerating vessel 30. This step is a radical departure from prior art etchant regeneration processes wherein the spent etchant is typically transferred directly from the chemical milling tank to the regeneration, or crystallization vessel.

By way of brief background, in developing the novel process of the present invention, laboratory experiments were conducted which involved adding to a small quantity of spent etchant contained within a beaker about 25 percent by volume aluminum trihydrate seed. The mixture thus formed was then diluted with water and the N1 (caustic) and the N2 (dissolved metal) was measured. Next, the diluted mixture was agitated for about four hours each day using a small magnetic stirrer. Following each agitation step, the alumina seed was allowed to settle and N1 and N2 measurements were made on the clear supernatant.

During the first week of the initial experiment, no reaction was observed. However, near the end of the second week the N1 level began to rise and the N2 level began to fall, signifying that regeneration reactor was occurring. By the end of the third week the reaction was complete and the etchant had been successfully regenerated. This result was quite surprising since the prior art caustic regenerators traditionally strive to precisely maintain a temperature of on the order of about 130° F. during the entire regeneration process.

The next experiment which was conducted during the development of the method of the invention was to perform a study similar to that done in the first experiment, but using a 1000 gallon cone-bottom tank. Surprisingly, this experiment also showed promise in that the reaction was complete in approximately ten days. More particularly, the reaction started with a caustic level of 10 ounce per gallon (oz/gal) and an aluminum level of 8.5 oz/gal. Upon completion the caustic level was approximately 15 oz/gal and the aluminum level was approximately 5.6 oz/gal.

Following the encouraging results achieved using the 1000 gallon tank, the experiment was repeated for a one year period using two rectangular shaped 9000 gallon tanks. However, in the conduct of this experiment, a disturbing trend was noted namely that after about four months in service the reaction process noticeably slowed and the solution within the tanks began turning a dark gray/brown color. After about ten months, it was observed that the reaction had ceased.

The next step in the development process was to replace the rectangular tanks with two 14,000 gallon dished-bottom tanks. Using these tanks seed suspension characteristics noticeably improved. However, once again, the solution continuously darkened with the passage of time and eventually the reaction process ground to a halt.

Believing that contamination of the reacting mixture might be the cause of reaction stoppage, a small quantity of clean, filtered, full-strength etchant was cooled to room temperature under laboratory conditions and water was added directly to the cooled solution. Surprisingly, contaminates immediately began precipitating and the solution turned cloudy. After standing overnight, the solution exhibited a significant amount of dark brown precipitation on the bottom of the containing vessel, which was presumed to consist of various metal-sulfur species which are known to interfere with crystal formation and retard the regeneration reaction.

The result of this latest experiment was totally unexpected. Since the chemical milling tanks used in conventionally chemical milling apparatus typically operate at temperatures in excess of 200° Fahrenheit, it is well known that a supersaturation state exists within the etch solution for the dissolved aluminum and various metal-sulfur species. Therefore, it was expected that some precipitation of the contaminants would occur as the reaction was cooled to room temperature and into a condition wherein the solution would no longer be in a super-saturated state. However, surprisingly it was apparent that the solution, even though cooled to ambient temperature, remained super-saturated and the step of adding water to the solution obviously functioned to precipitate the super-saturated metal-sulfur species out of solution. Importantly, it was also observed that this totally unexpected reaction was not immediate and better precipitation results could be achieved if the diluted solution was permitted to intermix for on the order of 24 hours. More particularly, further experimentation, in fact, verified that premature introduction of the diluent etchant solution into the reactor vessel or crystallizer resulted in a retarded regeneration reaction and a marked increase in solution darkening.

Based upon the foregoing experiments, it was concluded that, contrary to contemporary understanding, the mixing of water and the etchant solutions directly in the reactor vessel was clearly undesirable and resulted in the formation of contaminants which adversely affected the regeneration reaction and eventually caused the reaction to stop. This important and unexpected finding explains why conventional prior art caustic regeneration systems undesirably tend to markedly deteriorate in performance over time and require periodic shut down and costly clean-up.

Since the completion of the experimentation described in the preceding paragraphs, actual operating experience has now shown that, when the mixing of the water and the spent etchant is accomplished in a separate storage tank in accordance with the novel method of the present invention and then is cold filtered prior to being introduced into the reactor vessel, the reactor vessel remains clean and virtually no deterioration of performance of the system is observed over time. Additionally, the alumina produced in accordance with the process of the invention is of very high quality and snow white in color. In sharp contradistinction, prior art etchant regenerators, which mix the etchant and water in the reactor vessel, typically produce alumina of much lower quality which ranges in color from light gray to dark brown.

Experience has also shown that the method and apparatus of the present invention is particularly useful for regenerating Type II etchant which contains high levels of sodium sulfide. More particularly, while Type I etchant typically contain one or two oz/gal of sulfide, Type II etchants contain 5 to 8 oz/gal of sulfide. There is a much higher saturation level with the Type II etchant, which is typically heated to temperatures about 30° F. greater than Type I etchant. This leads to much more precipitation of sulfur species when the solution is converted to an unsaturated state. Surprisingly, experience has also shown that in actual practice, a typical Type II reactor tank will literally clean itself up when it is continuously charged with the regenerated etchant produced in accordance with the method of the present invention. Accordingly, reactor vessel clean-out requirements have been drastically reduced which, in turn, has markedly reduced labor expenditures and costly operating downtime.

Referring once again to FIG. 1, a second transfer means of the present form of the invention interconnects storage tank 16 with the reactor vessel 30 and functions to withdraw the diluted spent etchant from the storage tank 16 and transfers it in to the reactor vessel. The second transfer means of the invention here comprises a second pump 32 and a cold filter press 34. A conduit 36 interconnects second pump 32 with storage tank 16 while a conduit 38 connects pump 32 with cold filter 34. Similarly, a conduit 40 interconnects cold filter press 34 with the upper portion 30*a* of crystallizer vessel 30.

Also forming a part of the apparatus of the invention shown in FIG. 1 is a third transfer means for withdrawing the alumina trihydrate component from the reactor or crystallizer vessel for subsequent processing. This third transfer means comprises a conduit 42 which includes a first end 42*a* in communication with the bottom of reactor vessel 30 and a second end 42*b* which is in communication with a third pump 44. A conduit 46 interconnects third pump 44 which filter means shown here as filter press 50. The filter means or press 50 here functions to separate the alumina trihydrate from the mixture so that it can be captured within a capture vessel 52. As indicated in FIG. 1, after separation of the alumina trihydrate, the filtrate is returned to the reactor vessel 30 via a conduit 54.

A fourth transfer means, shown here as a conduit 58, functions to withdraw the regenerated etchant from the reactor vessel 30 and to return it to the chemical milling tank 12.

In accordance with one form of the method of the invention, the dissolved metal content of the etchant within tank 12 is periodically measured. When the dissolved metal content reaches a level of at least 40 grams per liter and preferably in the range of 54 to 85 grams per liter, the spent etchant is removed from tank 12 and transferred via heat exchanger 20 to high temperature filter press 22 for removal of solid contaminants. The remaining solution is then transferred to the storage tank 16 via conduit 26 by gravity or by any suitable pumping means. Next water is then added to the regeneration tank 16 to achieve a final sodium hydroxide concentration within the solution of on the order of between 72 and 100 grams per liter. This diluted etchant solution is then permitted to intermix within tank 16 for a period of time of between about 12 and 36 hours. Following complete intermixing of the water with the spent etchant, the cooled diluted mixture is transferred to cold filer press 34 by pump 32 for removal of solid contaminates from the mixture.

Filter press 34 is a conventional type of press and is readily commercially available from sources such as JWI, Inc. of Holland, Mich. High temperature filter press 22 is also readily commercially available and can be obtained from JWI, Inc. However, it is to be understood that any suitable filter means, including filtering devices and filter presses manufactured by other sources can also be used.

Following the important cold filtering of the diluted spent etchant, the filtered solution is transferred to crystallizer 30 via conduit 38. Crystallizer 30 comprises a holding vessel 31 which is preferably provided with a dished-out bottom, although this construction is not essential.

The next step in the process is to add aluminum trihydrate to the diluted etchant contained within the reactor vessel or crystallizer 30 using the aluminum trihydrate adding means shown in FIG. 1 and identified by the numeral 59. The optimum content of aluminum trihydrate with vessel 30 is about 25 to 45 percent by volume, but a range of between about 10 and 70 percent by volume will obtain reasonably satisfactory results.

During the mixing step, the diluted etchant and the alumina trihydrate are preferably agitated by any suitable agitation means as, for example, a mechanical mixer or agitator 60. Agitator 60 is of a character well understood by those skilled in the art and is readily commercially available. Normally the mixing process is permitted to continue for a period of approximately one week depending on the final sodium hydroxide and dissolved metal ranges desired. When the regeneration reaction is complete, agitation means or mixer 60, is de-energized and the alumina trihydrate is allowed to settle to the bottom of tank 30 for later transfer by the third transfer means of the invention. This settling time typically ranges from about 12 to about 36 hours following which the clear supernatant or regenerated etchant produced is transferred by the fourth transfer means into chemical milling tank 12.

As can be appreciated from the foregoing discussion, the process of the invention can be conducted in a semi-continuous mode by pumping in and out of tank 12 a predetermined amount of regenerated and used etchant. Alternatively, the regeneration process can be conducted only at required intervals to maintain the etchant in proper condition to obtain optimum milling results.

As previously mentioned, since regeneration is accomplished at ambient temperature, costly temperature control instrumentation is not required. Further, adherence to the method of the invention, results in the reactor vessel remaining substantially free of contamination and costly shut-down and vessel clean-up can be avoided. Additionally, the process of the invention can be carried on in a most economical manner since maintenance requirements are minimal and the extremely high quality alumina trihydrate which is received can be reused or sold. Since there is no requirement for the costly disposal of wastewater or other contaminants which result from system contamination operation costs are even further reduced.

Having now described the invention in detail in accordance with the requirements of the patent statutes, those skilled in this art will have no difficulty in making changes and modifications in the individual parts or their relative assembly in order to meet specific requirements or conditions. Such changes and modifications may be made without departing from the scope and spirit of the invention, as set forth in the following claims.

I claim:

1. A method for regenerating, within a reactor vessel, a spent Type II etchant solution of the character produced during chemical milling of aluminum and aluminum alloy parts which have been submersed into a Type II etchant solution contained within a chemical milling tank to form a regenerated etchant solution, said method comprising the steps of:

(a) removing the spent etchant solution from the chemical milling tank;

(b) cooling said spent etchant solution;

(c) adding water to said spent etchant solution to form an ambient temperature, diluted etchant solution;

(d) filtering said ambient temperature diluted etchant solution to form a filtered solution;

(e) transferring said filtered solution to the reactor vessel; and (f) adding alumina trihydrate to said filtered solution to form a mixed solution and to cause a reaction between said mixed solution and said filtered solution to form the regenerated etchant solution and alumina.

2. A method as defined in claim 1 comprising the step of holding said diluted etchant solution within a storage tank for a period of time between about 18 and 36 hours.

3. A method as defined in claim 1 including the further step of removing said alumina from said reactor vessel.

4. A method as defined in claim 1 including the further step of removing said regenerated etchant solution from the reactor vessel and transferring it to the chemical milling tank.

5. A method as defined in claim 1 including the further step of filtering the spent etchant solution following its removal from the chemical milling tank.

6. A method as defined in claim 1 including the further step of agitating said mixed solution within the reactor vessel.

7. A method for regenerating, within a reactor vessel, a spent Type II etchant solution of the character produced during chemical milling of aluminum and aluminum alloy parts which have been submersed into a Type II etchant solution contained within a chemical milling tank to form a regenerated etchant solution, said method comprising the steps of:

(a) transferring the spent etchant solution from the chemical milling tank to the storage tank;

(b) adding water to said spent etchant solution to form a diluted etchant solution;

(c) retaining said diluted etchant solution within said storage tank for a period of time of between about 18 and 36 hours to form an ambient temperature diluted etchant solution;

(d) filtering said ambient temperature diluted etchant solution to form a filtered solution;

(e) transferring said filtered solution to the reactor vessel;

(f) adding alumina trihydrate to said filtered solution to form a mixed solution and agitating said mixed solution to cause a reaction between said mixed solution and said filtered solution to form the regenerated etchant solution and alumina; and (g) removing said etchant solution and said alumina from the reactor vessel.

8. A method as defined in claim 7 in which water is added to said spent etchant solution to form a solution having a sodium hydroxide concentration of between about 72 and 100 grams per liter.

9. A method as defined in claim 7 including the further step of filtering the spent etchant solution prior to transferring it to said storage tank.

10. A method for regenerating, within a reactor vessel, a spent Type II etchant solution of the character produced during chemical milling of aluminum and aluminum alloy parts which have been submersed into a Type II etchant solution contained within a chemical milling tank to form a regenerated etchant solution, said method comprising the steps of:

(a) removing said spent etchant solution from the chemical milling tank and cooling the solution to form a cooled solution;

(b) transferring said cooled solution to a self-contained storage tank;

(c) adding water to said cooled solution to form a diluted etchant solution having a sodium hydroxide concentration of between 72 and 100 grams per liter;

(d) retaining said diluted etchant solution within said storage tank for a period of time of between about 18 and 36 hours to form an ambient temperature diluted etchant solution;

(e) filtering said ambient temperature diluted etchant solution to form a filtered solution;

(f) transferring said filtered solution to the reactor vessel;

(g) adding alumina trihydrate to said filtered solution to form a mixed solution and to cause a reaction between said mixed solution and said filtered solution to form the regenerated etchant solution and alumina; and (h) removing said regenerated etchant solution and said alumina from said reactor vessel.

11. A method as defined in claim 10 including the further step of returning said regenerated etchant solution to said chemical milling tank.

* * * * *